US005898359A

United States Patent [19]

Ellis

[11] Patent Number: 5,898,359

[45] Date of Patent: Apr. 27, 1999

[54] DIFFUSION-BARRIER MATERIALS FOR THICK-FILM PIEZORESISTORS AND SENSORS FORMED THEREWITH

[75] Inventor: Marion Edmond Ellis, Kokomo, Ind.

[73] Assignee: Delco Electronics Corp., Kokomo, Ind.

[21] Appl. No.: 08/994,113

[22] Filed: Dec. 19, 1997

[51] Int. Cl.[6] ..... H01C 10/10

[52] U.S. Cl. ..... 338/47; 338/13; 338/2; 338/42

[58] Field of Search ..... 338/47, 36, 42, 338/13, 2, 4

[56] References Cited

U.S. PATENT DOCUMENTS

| | | | |
|---|---|---|---|
| 4,125,820 | 11/1978 | Marshall | 338/4 |
| 4,320,664 | 3/1982 | Rehn et al. | 73/708 |
| 4,416,932 | 11/1983 | Nair | 428/209 |
| 4,651,120 | 3/1987 | Aagard | 338/4 |
| 4,959,262 | 9/1990 | Charles et al. | 428/329 |
| 5,058,435 | 10/1991 | Terry et al. | 73/727 |
| 5,089,172 | 2/1992 | Allison et al. | 252/512 |
| 5,295,395 | 3/1994 | Hocker et al. | 73/721 |
| 5,353,003 | 10/1994 | Maurer | 338/47 |
| 5,463,367 | 10/1995 | Ellis | 338/308 |

OTHER PUBLICATIONS

White, An Assessment of Thick–Film Piezoresistors on Insulated Steel Substrates, Hybrid Circuits, No. 20, (Sep. 1989), pp. 23–27.

Electro–Science Laboratories, Inc., Application Notes for Thick Film Heaters Made from Dielectric Tape Bonded Stainless Steel Substrates, (1994).

Stein et al., Thick Film Heaters Made From Dielectric Tape Bonded Stainless Steel Substrates, ISHM '95 Proceedings, Boston MA (1994), pp. 125–129.

Wahlers et al., Dielectric Tape Bonded Stainless Steel Substrates for High Power Packages, Hybrid Circuitry and Heater Uses, (1994).

Chitale et al., High Gauge Factor Thick Film Resistors for Strain Gauges, Hybrid Circuit Technology, (May 1989).

Chitale et al., Piezoresistivity in High GF Thick Film Resistors: Sensor Design and Very Thin YSZ Substrates, Proceedings 7th IM Conference, Yokohama, Japan (Jun. 1992), pp. 561–570.

Moriwaki et al., Interactions Between Thick Film Resistors and Alumina Substrate, Proceedings 7th IM Conference, Yokohama, Japan (Jun. 1992).

Prabhu et al., Interactions Between Base Metal Thick Film Inks and High Temperature Porcelain–Coated Steel Substrates, ISHM Symposium, Chicago IL (Oct. 1994), pp.331–340.

*Primary Examiner*—Michael L. Gellner
*Assistant Examiner*—Richard K. Lee
*Attorney, Agent, or Firm*—Jimmy L. Funke

[57] ABSTRACT

A thick-film strain-sensing structure for a media-compatible, high-pressure sensor. The strain-sensing structure generally includes a metal diaphragm, at least one electrical-insulating layer on the diaphragm, an interface layer on the electrical-insulating layer, and at least one thick-film piezoresistor on the interface layer for sensing deflection of the diaphragm. The interface layer and the electrical-insulating layers are preferably formed by thick-film processing, as done for the piezoresistors. For compatibility with the metal diaphragm, the electrical-insulating layer has a CTE near that of the diaphragm. The interface layer is formulated to inhibit and control diffusion of the electrical-insulating layers into the piezoresistors. For this purpose, the interface layer is formed from a composition that contains, in addition to a suitable organic media, alumina, zinc oxide, and at least one glass frit mixture comprising lead oxide, a source of boron oxide such as boric acid, silica and alumina. Additional constituents of the interface layer preferably include titania, cupric oxide, manganese carbonate as a source for manganese monoxide, and cobalt carbonate as a source of cobalt oxide.

20 Claims, 6 Drawing Sheets

DIFFUSION-BARRIER MATERIALS FOR THICK-FILM PIEZORESISTORS AND SENSORS FORMED THEREWITH

FIELD OF THE INVENTION

The present invention generally relates to thick-film materials and processes. More particularly, this invention relates to a material that is compatible with thick-film piezoresistive materials and inhibits diffusion of elements into a thick-film piezoresistor when present as an interface layer between the piezoresistor and a dielectric layer that electrically insulates the piezoresistor from a metallic substrate, such as a steel diaphragm of a pressure sensor.

BACKGROUND OF THE INVENTION

There is a continuous effort to develop pressure sensors that are lower in cost and smaller in size, yet are characterized by high reliability, sensitivity and linearity. Sensors finding wide acceptance on the basis of furthering these characteristics include those that utilize semiconductor materials with a micromachined sensing diaphragm, a notable example being micromachined single-crystal silicon pressure transducer cells manufactured using semiconductor fabrication processes. In the processing of such cells, a thin diaphragm is formed in a silicon wafer through preferential chemical etching. Ion implantation and diffusion techniques are then used to drive doping elements into the diaphragm, forming piezoresistive elements whose electrical resistance changes with strain (this ratio being termed the "gage factor"). As a result, deflection of the diaphragm causes a change in resistance value of the piezoresistive elements, which can then be correlated to the magnitude of the pressure applied to the diaphragm.

Diaphragms of single-crystal silicon pressure transducer cells are typically small, rarely exceeding a few millimeters in width, and are very thin, with a thickness of often less than 100 micrometers. The use of standard single-crystal silicon wafers and standard semiconductor device fabrication processes allows many such cells to be fabricated from a single wafer, providing some economy of scale. However, silicon is susceptible to chemical attack and erosion by various media, particularly in applications where a high-pressure medium is to be sensed, e.g., automotive applications that involve sensing brake fluid, oil, transmission fluid, hydraulic fluid, fuel and steering fluid pressures. For such applications, a pressure sensor must also be physically rugged and resistant to the hostile environment of the sensed medium, necessitating that a micromachined silicon pressure transducer cell include some form of protection in order to realize its advantageous operational characteristics in the chemically hostile environment. Current methods for producing media-compatible, high-pressure sensors include enclosing a silicon sensing chip in an inert fluid, such as a silicone oil or gel, and then further separating the sensing chip from the medium to be sensed with a metal diaphragm, such that pressure must be transmitted through the metal diaphragm and fluid to the sensing chip. While achieving some of the operational advantages of silicon pressure transducer cells, the manufacturing processes for these sensors are relatively expensive and complicated. As a result, these sensors are not suitable as mass-produced sensors for automotive applications.

As known in the art, alternative approaches include ceramic capacitive pressure sensors and ceramic diaphragms that use thick-film piezoresistors as strain sensing elements. However, each of these also have certain disadvantages, such as complex circuitry to detect capacitance changes, the requirement for ceramic-to-ceramic bonds, and a maximum pressure capability typically not exceeding about 1000 psi (about 7 MPa). For higher pressures, metal diaphragms have found use as the sensing element. Because metal diaphragms generally deflect more for a given thickness and pressure than ceramic diaphragms, sensing is performed by thin-film polysilicon or metal deposited on the metal diaphragm. The diaphragm must first be coated with a dielectric layer to electrically insulate the diaphragm from the thin-film resistors and conductors. A thin-film polysilicon layer is then deposited to form the piezoresistors, followed by thin-film metallization to provide electrical interconnects. As is conventional, the thin-film layers are typically deposited by such processes as chemical or physical vapor deposition. The equipment necessary for these processes is expensive, and deposition rates are extremely slow. Deposition of the thin-film layers requires multiple patterning, exposure, developing and stripping steps for the required thin-film photoresists and metallization, and must be carried out in a controlled environment to assure that no air borne particles are present on the surface to be coated. In addition, because such processes deposit thin-films usually no thicker than 10,000 angstroms, the surface of the metal diaphragm must be extremely smooth to avoid rough surface features penetrating through or producing discontinuities in the deposited thin films. Finally, the resistance of the resulting polysilicon thin-film piezoresistors can vary dramatically with temperature.

While achieving some of the operational advantages of silicon pressure transducer cells, metal diaphragm pressure sensors of the type described above have complicated manufacturing processes that render the sensors incompatible with mass-production applications. Media-compatible, high-pressure transducer cells that combine a corrosion-resistant metal diaphragm and thick-film piezoresistors have been proposed, as taught in U.S. patent application Ser. No. 08/954,266 now U.S. Pat. No. 5,867,886 to Ratell et al. (Attorney Docket No. H-198882). Such sensors are capable of sensing very high pressures while being chemically and mechanically robust, readily manufacturable, and relatively insensitive to temperature variations. At least one thick-film dielectric layer is required to electrically insulate the metal diaphragm from the thick-film piezoresistors. For compatibility with the metal diaphragm, the dielectric layer applied directly to the diaphragm must be formed of a material that will adhere to the metal diaphragm, withstand the strains induced as the diaphragm deflects, faithfully transmit such strains to the thick-film piezoresistors, and compensate for the coefficient of thermal expansion (CTE) mismatch between the metal diaphragm and piezoresistors. A complication is that metal oxide constituents of dielectric materials found suitable for this purpose have been found to diffuse into the thick-film piezoresistor and react with metal oxides present in the frit component of the piezoresistor, thereby significantly increasing the sheet resistivity of the piezoresistor, e.g., above the 3 to 10 kilo-ohm/square (kΩ/□) range typically desired. Accordingly, improved performance could be achieved if diffusion between the electrical-insulating layers and the thick-film piezoresistors was inhibited or at least controlled. While there have been suggestions to compensate CTE mismatch with temperature compensation electronics instead of manipulating the composition of the required insulating material, doing so undesirably increases processing and costs of the sensor.

SUMMARY OF THE INVENTION

It is an object of this invention to provide a strain-sensing structure that includes a corrosion-resistant metallic diaphragm, yielding a high-pressure sensor that is compatible with a wide variety of corrosive media.

It is another object of this invention that the strain-sensing structure employs thick-film technology, including thick-film electrical-insulating layers and thick-film piezoresistors, yielding a sensor that is capable of sensing very high pressures while being chemically and mechanically robust, readily manufacturable to be compatible with mass-production techniques, and relatively insensitive to temperature variations.

It is another object of this invention to inhibit diffusion of glass frit components between the electrical-insulating layers and the thick-film piezoresistors, so as to improve the performance of the sensor.

In accordance with a preferred embodiment of this invention, these and other objects and advantages are accomplished as follows.

The present invention provides a media-compatible, high-pressure sensor that employs a thick-film strain-sensing structure. The strain-sensing structure generally includes a metal diaphragm, at least one electrical-insulating layer on the diaphragm, an interface layer on the electrical-insulating layer, and one or more thick-film piezoresistors on the interface layer for sensing deflection of the diaphragm. For purposes of compatibility with a wide variety of media, the metal diaphragm is preferably formed of a steel, most preferably a stainless steel such as an AISI Type 300 or 400 Series.

The interface layer and the electrical-insulating layers are preferably formed by thick-film processing, as done for the piezoresistors. For compatibility with the metal diaphragm, the electrical-insulating layer applied to the diaphragm must be formulated such that it adheres to the metal diaphragm and has a CTE that matches or is close to that of the metal diaphragm. While the frit present in such an electrical-insulating layer may contain many of the same metal oxides present in the frit component of the piezoresistors, the relative proportions of a given metal oxide may be such that interdiffusion during firing of the thick-film piezoresistors creates a third glass composition whose impact on the piezoresistors depends on the degree of diffusion and the proportion that the newly created frit assumes relative to the total frit content of the piezoresistors. It is not unusual for the new frit to be of a different phase, relative to solidus and liquidus temperatures, with consequent changes in softening point, melting point, wetting and CTE as a result. It is well documented in the industry that the foregoing properties of glass frits are primary determinants of thick-film resistor properties such as sheet resistivity, temperature coefficient of resistance (TCR), stability and piezoresistivity. According to this invention, the intermingling of the glass frit components of the electrical-insulating layer, as a result of diffusion, increases the sheet resistivity of the piezoresistors and negatively affecting their performance.

As a solution, the interface layer of this invention is formulated to inhibit and control diffusion of the electrical-insulating layers into the piezoresistors. The interface layer is characterized by particulate alumina ($Al_2O_3$, aluminum oxide) and particulate zinc oxide (ZnO) closely divided and suspended in a glass matrix, forming an alumina glass ceramic, preferably a lead-alumina-borosilicate glass composed primarily of lead oxide, alumina, boron oxide and silica. To obtain the preferred composition, the interface layer is formed from a composition that contains, in addition to a suitable organic media, alumina, zinc oxide, and a glass frit mixture that preferably contains lead oxide (PbO; litharge), a source of boron oxide ($B_2O_3$) such as boric acid ($H_3BO_3$), silica ($SiO_2$, silicon dioxide), and alumina. The interface layer may also include such constituents as titania ($TiO_2$, titanium dioxide), cupric oxide (CuO), manganese monoxide (MnO), and cobalt oxide (CoO), the latter three preferably being provided alone or in combination.

According to this invention, the interface layer separates the piezoresistors from the electrical-insulating layers, and inhibits diffusion into the piezoresistors of constituents in the electrical-insulating layers. As a result, the sheet resistivity of the thick-film piezoresistors exhibits minimal change following firing. Importantly, the interface layer of this invention has been shown to relay strains from the diaphragm and electrical-insulating layers to the piezoresistor with negligible degradation. Unexpectedly, interface layers having the composition set forth above have also been determined to actually increase the gage factor of the piezoresistor by as much as 25% to 40%. Another unexpected advantage of this invention is that the detrimental effect of the high CTE of a metal diaphragm on resistance versus temperature of a piezoresistive sensor has been found to be largely offset by the presence of the interface layer, thereby eliminating the need for temperature compensation electronics as required by sensors of the past.

In view of the above, the present invention provides for a pressure sensor that combines a corrosion-resistant metal diaphragm and thick-film technology, and avoids thick-film interactions to enable accurate sensing of very high pressures, e.g., in excess of 10,000 psi (about 70 MPa). Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
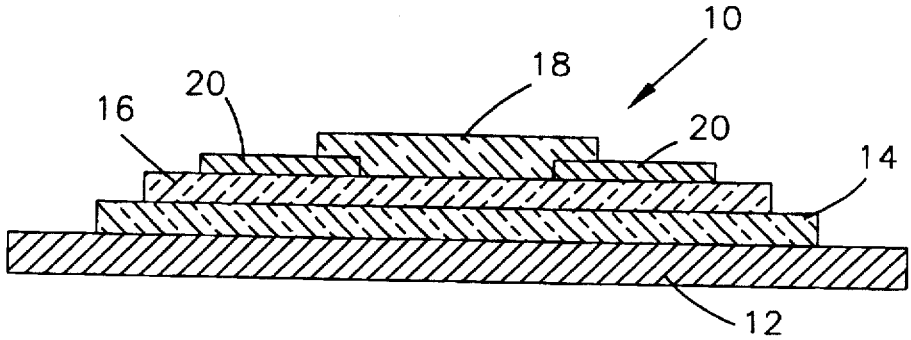
FIG. 1 is a cross-sectional view of a pressure sensing structure that includes an interface layer in accordance with this invention.

FIG. 1 represents a pressure sensing structure 10 for a high-pressure sensor in accordance with the present invention. The sensing structure 10 is formed to be capable of deflecting in response to a pressure applied by a medium to the structure 10. As represented in FIG. 1, the sensing structure 10 includes multiple layers 14, 16, 18 and 20 on a metal diaphragm 12. According to this invention, the diaphragm 12 may be in the form of a monolithic metal structure formed by either conventional stamping, machining or micromachining a metal body, the latter using known etching techniques, with the remainder of the metal body forming an annular-shaped support (not shown) for the diaphragm 12. Alternatively, it is foreseeable that the diaphragm 12 could be a discrete member that is permanently secured, such as by welding, to a support. In a preferred embodiment, the diaphragm 12 is formed of a steel alloy, and preferably stainless steel in order to achieve a suitable level of corrosion resistance to the given medium. While various grades of steel could be used, preferred alloys are AISI Type 300 and 400 Series alloys, with Types 304, 316, 404, 430, 430 S17 and 444 being particularly suitable as being compatible with materials suitable for the layer 14 contacting and adhered to the metal diaphragm 12, as will be discussed below. However, it is within the scope of this invention to use other stainless steels, as well as carbon and galvanized steels and other metals.

The layers on the sensing structure 10 are a single thick-film dielectric layer 14, a thick-film interface layer 16, a thick-film piezoresistor 18, and contacts 20. The piezoresistor 18 is employed to sense the deflection of the diaphragm 12, while the dielectric layer 14 is necessary to electrically insulate the piezoresistor 18 from the diaphragm 12. The contacts 20 enable the use of wire bonding to electrically interconnect appropriate conditioning circuitry (not shown) to the piezoresistor 18. Alternatively, a chip carrying the circuitry can be connected to the contacts 20 by known flip chip attachment methods. While a single piezoresistor 18 is shown, it will be understood that any number of piezoresistors could be used, such as for the purpose of using a Wheatstone bridge to process the output of the sensing structure 10.

A preferred aspect of this invention is that the dielectric layer 14, the interface layer 16, the piezoresistor 18 and the contacts 20 are each formed by thick-film processes, though it is foreseeable that laminated tapes could be used. As thick films, each is about 25 μm (about one mil) or more in thickness, and formed by depositing an appropriate paste or ink using a printing technique or similar process. Consequently, the dielectric and interface layers 14 and 16, the piezoresistor 18 and contacts 20 are distinguishable from thin-film structures. The piezoresistor 18 is also distinguishable from implanted and diffused piezoresistors employed with single-crystal pressure cells. According to the invention, suitable inks for the piezoresistor 18 and contacts 20 are known in the art. For example, a commercially available resistive ink found suitable for the piezoresistor 18 is available under the name ESL 3414B from Electro-Science Laboratories, Inc., while suitable conductor inks for the contacts 20 include silver-palladium and gold compositions identified as 7484 and 5760, respectively, and commercially available from E. I. DuPont de Nemours and Company, Inc., of Wilmington, Del. Thick-film printing processes for depositing the inks and the thermal processing required to fire such inks are generally known in the art.

Suitable resistive materials for the piezoresistor 18 generally have sheet resistances of about 3 to 10 kilo-ohms/square. The ESL 3414B composition yields thick-film piezoresistors within this range that exhibit a gage factor (the ratio of the change in resistance ($\Delta R$) to strain ($\Delta L/L$)) of about 15 to 20. However, the electrical resistance of thick-film resistive materials is known to vary with temperature, and can be permanently altered when subjected to a hostile environment. The sensitivity of a thick-film resistor to temperature is indicated by its temperature coefficient of resistance (TCR), as measured in parts per million per °C. (ppm/°C). Thick-film piezoresistors can typically be calibrated to have a TCR in the range of about ±200 to about ±100 ppm/°C. when measured across a temperature range of −55° C. and 125° C., which are standard temperature extremes used by the industry to evaluate the electrical characteristics of thick-film resistors.

According to known engineering principles, the diameter and thickness of the diaphragm 12 are relatively sized to ensure that the diaphragm 12 is sufficiently flexible to respond to changes in pressure in the medium. The flexibility of the metal diaphragm 12 is particularly demanding of the thick-film dielectric layer 14. In particular, to be compatible with the metal diaphragm 12, the dielectric layer 14 must be formed of a material that will adhere to the diaphragm 12 and compensate for the large CTE mismatch between the metal diaphragm 12 and the thick-film piezoresistor 18. In addition, the dielectric layer 14 must withstand the strains induced as the diaphragm 12 deflects, yet faithfully transmit such strains to the thick-film piezoresistor 18. Such problems are not generally confronted when using thin-films employed by pressure sensors of the prior art. The present invention fulfils these requirements by using at least one dielectric layer 14 that preferably contains one or more bonding agents and a mixture of metal oxides that, when the ink for the dielectric layer 14 is fired, provide for a coefficient of thermal expansion (CTE) that approximately equals that of the diaphragm 12. Suitable bonding agents are those that are noncorrosive to the material of the diaphragm 12. Other possible materials that could be substituted for the metal oxides include porcelain, quartz, $SiO_2$, $Si_3N_4$, SiC, etc. Particularly suitable ink compositions for the dielectric layer 14 include ESL D-4914 and ESL D-4913B commercially available from Electro-Science, and QM44 from DuPont. The dielectric layer 14 can alternatively be formed with a dielectric tape, such as ESL D-41030-25C from Electro-Science and HD-3 from DuPont. These dielectric materials, though developed for static applications such as heating elements, have been surprisingly found to exhibit suitable mechanical properties for dynamic applications such as the flexing metal diaphragm 12 of this invention. of significance is that thick-film dielectric materials determined to be compatible with steel sensing diaphragms contain glass frits composed of metal oxides that tend to diffuse into the piezoresistor 18 during firing of the dielectric ink. According to this invention, the interface layer 16 inhibits diffusion of metal oxides from the frit component of the dielectric layer 14 into the piezoresistor 18, while also being compatible with the materials for the dielectric layer 14 and the piezoresistor 18. Compositions for the interface layer 16 that have been determined to provide this function contain particulate alumina ($Al_2O_3$, aluminum oxide) and particulate zinc oxide (Zno) closely divided and suspended in a glass matrix forming an alumina glass ceramic. The glass is preferably a lead-alumina-borosilicate glass composed primarily of lead oxide, alumina, boron oxide and silica. The interface layer 16 having the preferred composition is formed from dielectric ink compositions that contain, in addition to a suitable organic media, alumina, zinc oxide, and a glass frit mixture that preferably contains lead oxide (PbO, litharge), a source of boron oxide ($B_2O_3$) such as boric acid ($H_3BO_3$), silica ($SiO_2$, silicon dioxide), and alumina. Additional glass constituents, preferably including titania ($TiO_2$, titanium dioxide), cupric oxide (CuO), manganese monoxide (MnO) from manganese carbonate ($MnCO_3$), and cobalt oxide (CoO) from cobalt carbonate ($CoCO_3$), the latter three being provided alone or in combination, are introduced into the glass to act as fine tuning control of thermal expansion of the alumina glass ceramic and/or to add color to it. A preferred particle size for the dry constituents is about 230 mesh (about 64 μm) to about 325 mesh (about 45 μm), though the use of larger and smaller particles is foreseeable.

Suitable ranges for the constituents of the ink composition of the interface layer 16 are, in weight percent, about 15% to about 35% alumina, about 3% to about 6% zinc oxide, and about 34% to about 53% of the glass frit materials, the balance being the organic media. Notably, sufficient particulate alumina is present in the interface layer 16 to achieve physical properties similar to that of alumina substrate materials. Suitable ranges for the individual constituents of the glass frit materials are, in weight percent, about 50% to about 74% lead oxide, about 10% to about 25% boric acid as a source of boron oxide, about 8% to about 26% silica, up to about 12% alumina, up to about 3% titania, and up to 8% of cupric oxide, manganese carbonate as a source of manganese monoxide, and/or cobalt carbonate as a source of cobalt oxide. More particular ranges for the last three constituents are, in weight percent, about 0.5% to about 3.0% cupric oxide, about 0.5% to about 4.0% manganese carbonate, and about 3.5% to about 4% cobalt carbonate. A suitable organic media is a terpineol/ethyl cellulose solution, though other vehicles such as butyl carbitol acetate/acrylic resin could be used.

During the investigations that led to the present invention, several ink compositions containing one or more of three glass frit mixtures were shown to be effective for the interface layer 16. Different glass frit mixtures were used in order to provide a more controlled evaluation by which a desired CTE could be more selectively obtained for the resulting interface layer 16. Importantly, selectively varying the relative amounts of the constituents was shown to be capable of driving the value and direction, positive or negative, of sheet resistivity (Rs), the sensitivity to strain and/or pressure (gain), and the response of resistance and gain (gage factor) to temperature (TCR and TCGF, respectively). The ink compositions and glass frit mixtures are summarized below in Tables I and II, respectively. In each case, the organic media was a terpineol/ethyl cellulose solution.

TABLE I

INK COMPOSITION (IN WEIGHT PERCENT)

| | Ink #1 | Ink #2 | Ink #3 | Ink #4 | Ink #5 | Ink #6 |
|---|---|---|---|---|---|---|
| $Al_2O_3$ | 32.9 | 31.0 | 34.9 | 30.0 | 15.0 | 30.0 |
| ZnO | 3.4 | 4.0 | 5.8 | 5.0 | 5.0 | 5.0 |
| Frit #1 | 36.3 | 19.0 | 17.3 | 19.0 | 26.5 | — |
| Frit #2 | — | 19.0 | 17.3 | 19.0 | 26.5 | — |
| Frit #3 | — | — | — | — | — | 38.0 |
| Media | 27.4 | 27.0 | 24.7 | 27.0 | 27.0 | 27.0 |

TABLE II

FRIT MIXTURE (IN WEIGHT PERCENT)

| | Frit #1 | Frit #2 | Frit #3 |
|---|---|---|---|
| PbO | 53.3 | 53.3 | 52.8 |
| $H_3BO_3$ | 15.1 | 15.1 | 15.0 |
| $SiO_2$ | 19.4 | 19.4 | 19.2 |
| $Al_2O_3$ | 8.2 | 8.2 | 8.1 |
| $TiO_2$ | 1.0 | 1.0 | 0.5 |
| CuO | 3.0 | — | 0.5 |
| $CoCO_3$ | — | 3.0 | — |
| $MnCO_3$ | — | — | 4.0 |

The investigations performed with the above ink compositions and glass frit mixtures for the interface layer 16 included comparative tests performed on alumina and steel substrates and pressure sensor diaphragms, as generally summarized below.

EXPERIMENT #1

Test substrates were formed of 96% pure alumina and AISI Type 300 stainless steel having thicknesses of about 0.035 inch (about 0.9 mm) and about 0.020 inch (about 0.5 mm), respectively. The stainless steel specimens were prepared by first sandblasting their surfaces, then oxidizing with two passes through a belt furnace at a peak temperature of about 850° C. to about 950° C. Following oxidation, the steel specimens were washed to remove any contamination and oily residue.

The stainless steel substrates were printed and fired with two layers of ESL D-4914 dielectric ink and one layer of ESL D-4913B dielectric ink to form insulating dielectric layers corresponding to layer 14 in FIG. 1. Each layer was printed with a 230 mesh screen OF 1.4 mil (about 36 μm) diameter wire and 0.9 mil (about 23 μm) emulsion thickness. For firing, the substrates were divided into two groups. One group was fired in a conventional furnace having a peak temperature of about 850° C. for a duration at or near the peak temperature of about ten minutes. Total cycle time, from entrance to exit, was about forty-five minutes. The second group was fast-fired in an infrared (IR) furnace having a peak temperature of about 915° C. for a duration at or near the peak temperature of about three minutes. Total cycle time, from entrance to exit, was about fifteen minutes for the second group.

An interface layer 16 of the Ink #1 composition was then printed and fired over the dielectric layers 14 on each of the steel substrates under the same conditions as the dielectric layers 14. Contacts 20 were then formed by printing the DuPont 7484 ink composition on the alumina substrates and on the interface layers 16 of the steel substrates with a 325 mesh screen of about 0.9 mil (about 23 μm) diameter wire and about 0.5 mil (about 13 μm) emulsion thickness. The inks were dried and fired, with the alumina substrates being divided into two groups as was done with the steel substrates, the first group of each type of substrate being fired at about 850° C. using a conventional oven and the second group being fired in the IR furnace at about 915° C. Thereafter, pairs of thick-film piezoresistors 18 oriented transversely to each other were formed on each specimen by printing, drying and firing the ESL 3414B piezoresistor ink in the same manner as was done for the contacts 20.

The resulting thick-film piezoresistors 18 were then evaluated for sheet resistivity, TCR and resistance change versus strain (i.e., gage factor). Sheet resistivity (Rs) in ohms/□ and TCR in ppm/°C. at about −40° C. ("CTCR") and about +125° C. ("HTCR") for each group are summarized below in Table III.

TABLE III

| Substrate | Firing | Rs | CTCR | HTCR |
|---|---|---|---|---|
| Alumina | 850° C. | 3.5K | 124 | 146 |
| Alumina | 915° C. | 2.6K | 162 | 177 |
| Stainless steel | 850° C. | 3.3K | 328 | 456 |
| Stainless steel | 915° C. | 3.1K | 349 | 464 |

As the data indicate, the sheet resistivity values obtained on the stainless steel substrates closely approximate those obtained on the alumina substrates, which is an object of this invention. The differences between the TCR values of the alumina and steel substrates are explained by the large CTE difference between alumina (having a CTE range of about 6.54 ppm/°C.) and stainless steels (having a CTE range of about 10 ppm/°C. to about 18 ppm/°C., depending on the type of steel).

Figure 2:
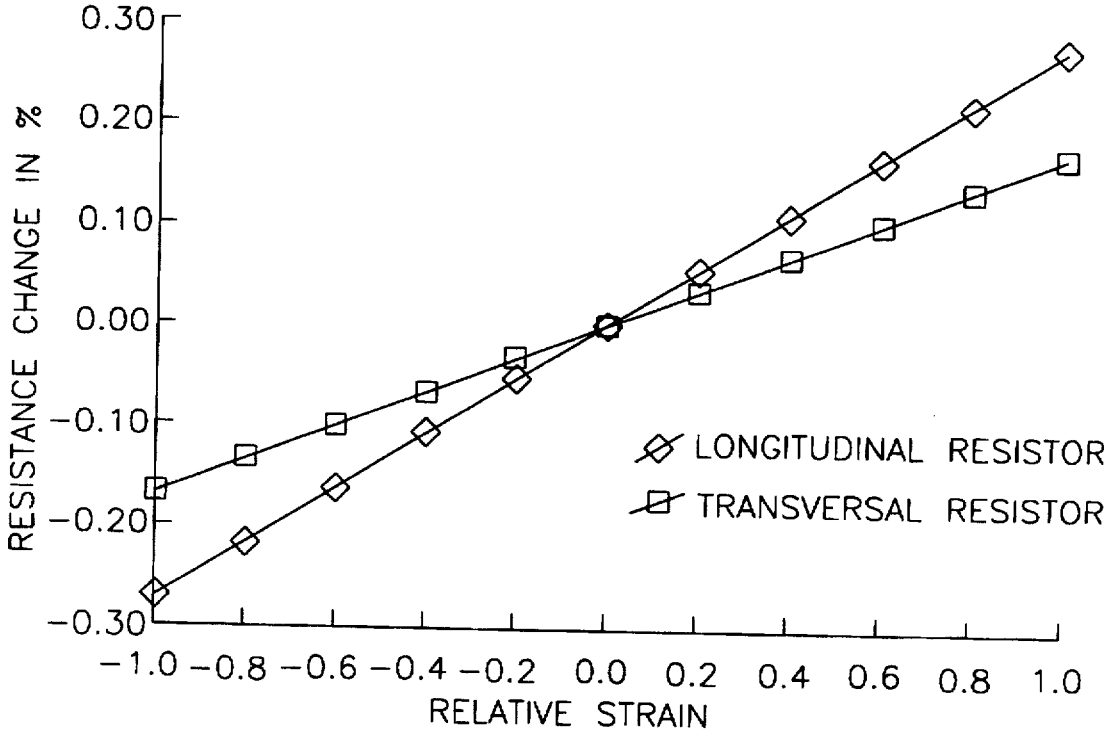
FIG. 2 is a graph showing resistance change versus strain of the pressure sensing structure of FIG. 1.

Resistance versus strain data were obtained by deflecting the substrates while supported at opposite longitudinal ends, such that one piezoresistor of each set was considered to be oriented "longitudinal" and the remaining piezoresistor oriented "transversal" relative to the orientation of the substrate during bending. The strain data from this test are summarized in FIG. 2, which shows that, under equivalent strain at a given temperature, the resistance change on stainless steel is essentially the same as on alumina, which is another object of this invention.

EXPERIMENT #2

Dielectric and interface layers were printed and fired on four groups of stainless steel substrates using the same screen parameters noted above as follows.

TABLE IV

| GROUP | DIELECTRIC SEQUENCE | INTERFACE |
|---|---|---|
| A | (1) layer ESL D-4914 + (1) layer ESL D-4913B | Ink #1 |
| B | (1) layer ESL D-4914 + (1) layer ESL D-4913B | Ink #2 |
| C | (2) layers ESL D-4914 + (1) layer ESL D-4913B | Ink #1 |
| D | (2) layers ESL D-4914 + (1) layer ESL D-4913B | Ink #2 |

Between the printing of each dielectric layer, the substrates were fired in an IR furnace with a peak temperature of about 915° C. for a duration at peak temperature of about three minutes as in Experiment #1. The substrates of each group were then printed and fired with the DuPont 7484 conductive ink and the ESL 3414B piezoresistive ink to form contacts and piezoresistors, respectively. Firing was performed in an IR furnace for about three minutes at a peak temperature of either 895° C. or 915° C. for a duration of about three minutes at the peak temperature. Screening of the piezoresistive ink was done in such a way as to achieve thick-film piezoresistors of different thicknesses according to Table V below.

TABLE V

| GROUP | PIEZORESISTOR PRINTING CONDITIONS | FIRING |
|---|---|---|
| A1 | 230 Mesh/1.4 mil wire/0.9 mil emulsion | 895° C. |
| B1 | 230 Mesh/1.4 mil wire/0.9 mil emulsion | 915° C. |
| A2 | 325 Mesh/1.1 mil wire/0.4 mil emulsion | 915° C. |
| B2 | 325 Mesh/1.1 mil wire/0.4 mil emulsion | 895° C. |
| C1 | 230 Mesh/1.4 mil wire/0.9 mil emulsion | 915° C. |
| D1 | 230 Mesh/1.4 mil wire/0.9 mil emulsion | 895° C. |
| C2 | 325 Mesh/1.1 mil wire/0.4 mil emulsion | 895° C. |
| D2 | 325 Mesh/1.1 mil wire/0.4 mil emulsion | 915° C. |

Figure 3:
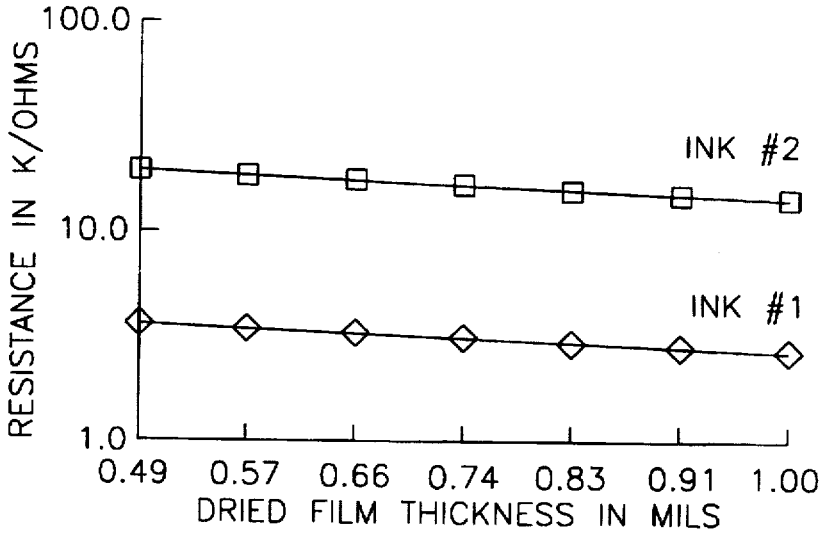
FIGS. 3, 4 and 5 are graphs showing, respectively, resistance versus thickness of interface layers of different compositions, gage factor versus thickness of interface layers of different compositions, and resistance versus temperature for interface layers of different thicknesses and compositions.
Figure 4:
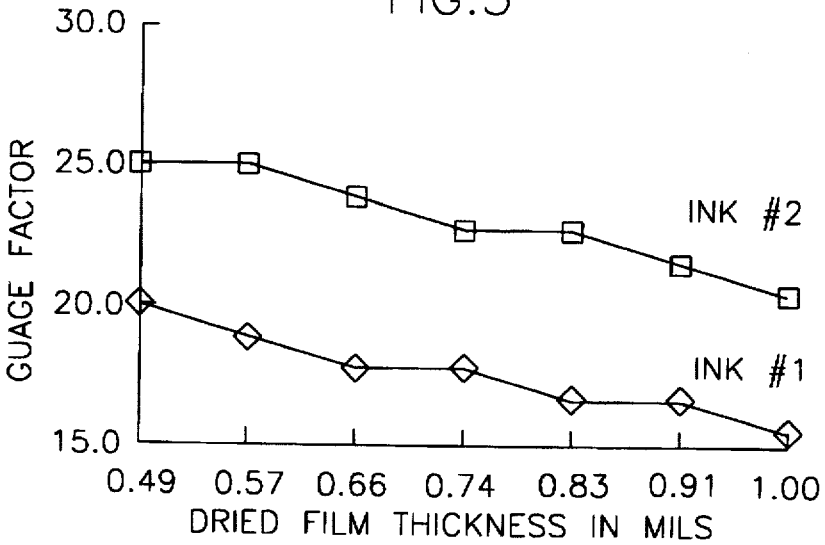
Figure 5:
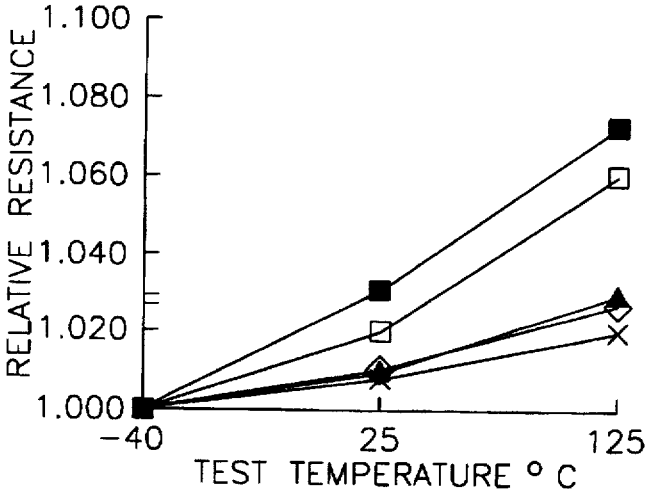

Following firing, the thick-film piezoresistors were evaluated for sheet resistivity, TCR and gage factor using the resistance versus strain test method of Experiment #1. The test data were statistically analyzed to determine the impact of print thickness, firing, interface composition, and dielectric composition and sequence on sheet resistance, TCR and gage factor. The results unexpectedly showed that sheet resistance, TCR and gage factor were overwhelmingly determined by the interface layer composition. FIGS. 3 and 4 show the average sheet resistances and gage factors for piezoresistors isolated from the dielectric layers with either Ink #1 or Ink #2 relative to interface layer thickness, while FIG. 5 shows resistance versus temperature for baseline alumina substrates printed with the same piezoresistive inks under the same conditions, and for the stainless steel substrates with piezoresistors isolated from the dielectric layers with either Ink #1 or #2 at the different test thicknesses.

Unexpectedly, FIG. 4 shows that the composition of the interface layer actually enhanced the gage factor of the piezoresistor from the initial 15 to 20 typical for the ESL 3414B material, to about 21 to 25, a minimum increase of 25% depending on the thickness of the piezoresistor. Also unexpected was that the interface layer formed with Ink #2 was capable of offsetting the effect of the higher CTE of stainless steel relative to resistance versus temperature, as shown in FIG. 5.

EXPERIMENT #3

Testing was then performed on actual pressure sensing cells using ESL D-4914 and DuPont QM44 as the inks for the dielectric layers. The sensing cells had diaphragms approximately eight mils (about 0.2 mm) thick formed of AISI Type 304L stainless steel, and were prepared for printing by bead blasting and oxidation by firing in a belt furnace with a peak temperature of about 915° C. and a duration at peak temperature of about ten minutes. Half of the diaphragms were printed with two layers of QM44 using a 230 mesh screen, while the remaining diaphragms were printed with two layers of ESL D-4914 using the 230 mesh screen. Between printings, the diaphragms were dried at about 150° C. for about ten to fifteen minutes, and then fired in a belt furnace having a peak temperature of about 850° C. for a duration at peak temperature of about ten minutes. The dried thickness of each dielectric layer was about 1.5 mils (about 38 μm), yielding a total fired thickness of about 1.5 mils.

The diaphragms printed with ESL D-4914 and QM44 were then each divided into four groups, with the diaphragms of each group being printed with a single layer of one of Inks #2 through #5 using a 230 mesh screen to achieve a dried thickness of about 1.5 mils. Drying and firing were performed in the same manner as were the dielectric layers. The fired substrates were printed with the DuPont 5760 and 7484 thick-film conductive inks to form the appropriate circuitry for the sensing cells, then dried and fired under the same conditions as the dielectric layers. The ESL 3414B piezoresistive ink was then printed using a 325 screen mesh onto the interface layers to yield a thickness of about 1.0 mil (about 25 μm) after drying. Drying and firing conditions were again the same as that for the dielectric layers.

The resulting pressure sensing cells were then evaluated for resistance. Average sheet resistance values for each group were as follows.

TABLE VI

| DIELECTRIC | INTEREACE | SHEET RESISTIVITY |
|---|---|---|
| ESL D-4914 | Ink #2 | 6.1kΩ/□ |
| ESL D-4914 | Ink #3 | 3.2 |
| ESL D-4914 | Ink #4 | 5.8 |
| ESL D-4914 | Ink #5 | 2.7 |
| QM44 | Ink #2 | 6.0 |
| QM44 | Ink #3 | 2.7 |
| QM44 | Ink #4 | 9.3 |
| QM44 | Ink #5 | 7.9 |

The sensing cells were then assembled using standard practices into pressure sensors (minus amplification and temperature compensation circuitry) and subjected to pressure and temperature testing. The pressure ranged from zero up to about 1029 kPa, and temperature excursions were from about 25° C. to −40° C., about −40° C. to 25° C., and about 25° C. to 125° C. The resulting data for normalized pressure sensor output at 1029 kPa ("Output") and response of gain (gage factor) to temperature at the low and high temperature extremes ("CTCGF" and "HTCGF," respectively) were statistically analyzed using multiple regression. $R^2$ values of very near 1.0 were obtained for each of the following regression predictor equations:

ESL D-4914 Dielectric Layer $$\text{Output}=0.45X_1-0.025X_2+0.0132X_3+0.8X_4-1.909 \quad \text{Eq. (1)}$$

$$\text{CTCGF}=716.5X_1-701.5X_2+173.2X_3+1272X_4-52582.3 \quad \text{Eq. (2)}$$

$$\text{HTCGF}=3715X_1-3225X_2+923X_3+6779X_4-273949 \quad \text{Eq. (3)}$$

where:

$X_1$=weight percent alumina
$X_2$=weight percent zirconia
$X_3$=weight percent Frit #1
$X_4$=weight percent Frit #2

QM44 Dielectric Layer $$\text{Output}=0.111X_1-0.111X_2+0.039X_3+0.197X_4-9.64 \quad \text{Eq. (4)}$$

$$\text{CTCGF}=2741X_1-4613X_2+726X_3+4833X_4-165263 \quad \text{Eq. (5)}$$

$$\text{HTCGF}=31554X_1-58646X_2+7667X_3+55390X_4-1852071 \quad \text{Eq. (6)}$$

where:

$X_1$=weight percent alumina
$X_2$=weight percent zirconia
$X_3$=weight percent Frit #1
$X_4$=weight percent Frit #2

The data for the sensing cells with the ESL D-4914 and QM44 dielectric layers are summarized in Tables VII and VIII, respectively.

TABLE VII

| | ESL D-4914 Dielectric Layer and an Interface Layer of: | | | |
|---|---|---|---|---|
| | Ink #2 | Ink #3 | Ink #4 | Ink #5 |
| Normalized Output | | | | |
| Actual | 1.15 | 1.12 | 1.08 | 1.11 |
| Predicted | 1.16 | 1.13 | 1.09 | 1.11 |
| CTCGF (ppm/° C.) | | | | |
| Actual | −108 | 1492 | −123 | −31 |
| Predicted | −108 | 1494 | −121 | −30 |
| HTCGF (ppm/° C.) | | | | |
| Actual | 450 | 7650 | −40 | 2000 |
| Predicted | 453 | 7653 | −37 | 2003 |

TABLE VIII

| | QM44 Insulator Dielectric and an Interface Layer of: | | | |
|---|---|---|---|---|
| | Ink #2 | Ink #3 | Ink #4 | Ink #5 |
| Normalized Output | | | | |
| Actual | 1.27 | 1.04 | 1.27 | 1.16 |
| Predicted | 1.27 | 1.04 | 1.27 | 1.17 |
| CTCGF (ppm/° C.) | | | | |
| Actual | 6892 | −169 | −462 | 108 |
| Predicted | 6876 | −188 | −478 | 100 |
| HTCGF (ppm/° C.) | | | | |
| Actual | 89590 | −110 | −610 | −990 |
| Predicted | 89594 | −105 | −606 | −988 |

Figure 6:
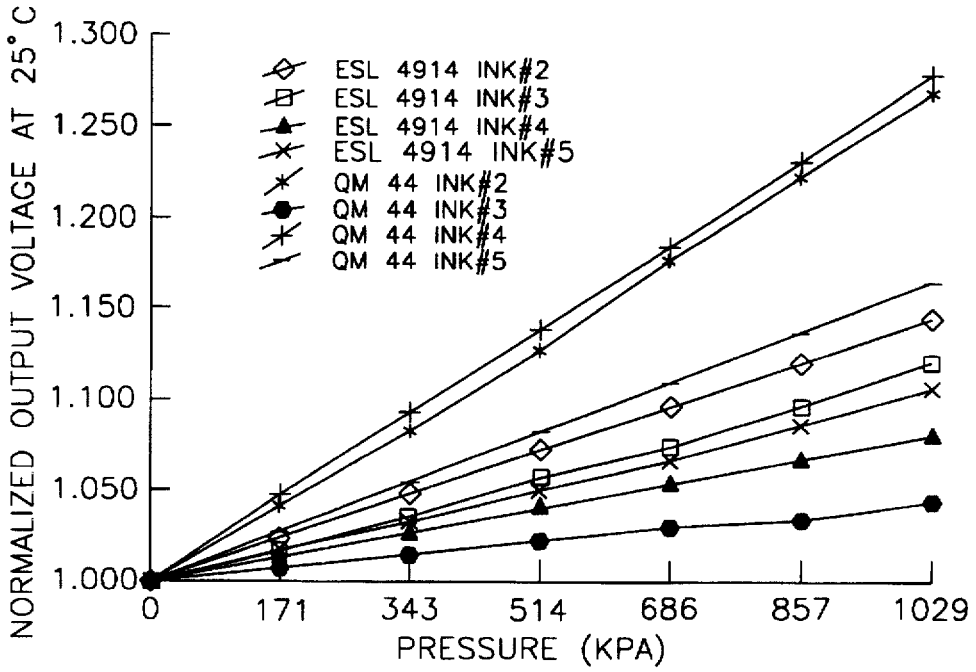
FIG. 6 is a graph showing normalized sensor output versus applied pressure on pressure sensor diaphragms formed from 304 L stainless steel to include insulative layer compositions ESL D-4914 and QM44, each in combination with various interface layers.

The closeness of the predicted data to the actual data for output and TCGF shown in Tables VII and VIII demonstrates the robust relationship between the interface compositions and the magnitude and direction of output and TCGF. The impact on output can better be appreciated by considering FIG. 6, which demonstrates that the interface layer composition determines the slope, from 0 to 1029 kPa, of the output line. The greater the slope, the greater the normalized output and gage factor.

Figure 7:
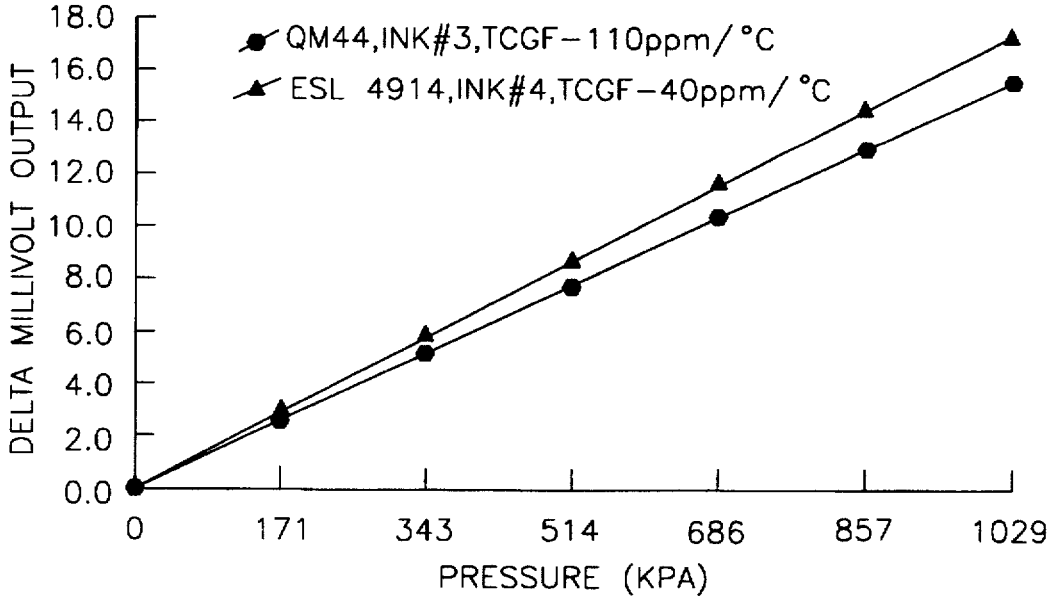
FIG. 7 is a graph showing normalized sensor output versus applied pressure on pressure sensor diaphragms formed from 304 L stainless steel to include interface layers providing TCGF values within about ±170 ppm/°C. for insulative layer compositions ESL D-4914 and QM44.

It is apparent from Tables VII and VIII that the relationships differ from insulator to insulator, as could be expected since insulator compositions from different vendors tend to vary in their compositions. However, at least one interface composition giving acceptable output and TCGF values within about ±170 ppm/°C. has been determined for each of the insulator dielectric compositions tested, as shown in FIG. 7: Ink #4 for ESL D-4914 dielectric layers and Ink #3 for QM44 dielectric layers.

Figure 8:
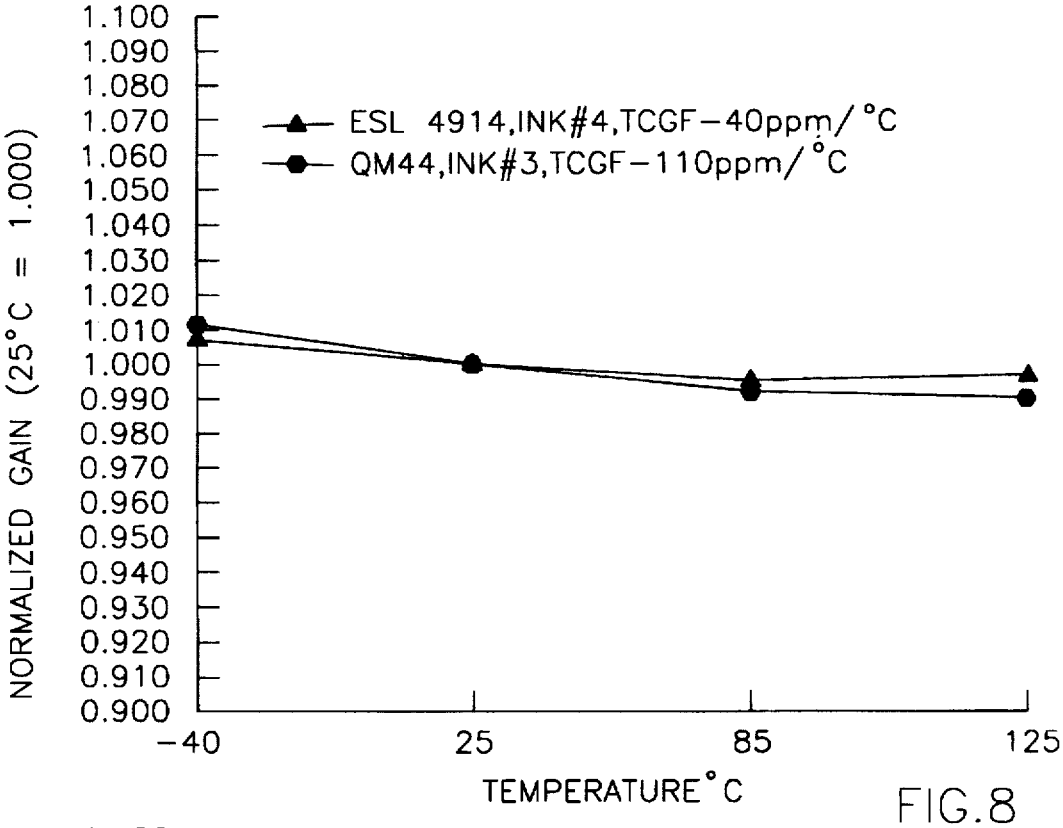
FIG. 8 is a graph showing the dependence of normalized gain on temperature for pressure sensor diaphragms formed from 304 L stainless steel to include interface layers providing TCGF values within about ±170 ppm/°C. for insulative layer compositions ESL D-4914 and QM44.

Pressure sensors with TCGF (temperature coefficient of gage factor) values within about ±175 ppm/°C. represent a variance in gain as a result of temperature of about ±1%, as shown in FIG. 8. Within this range, a pressure sensor requires little or no temperature compensation electronics since there is little appreciable error due to a loss of gain, and is therefore less costly to produce. Accordingly, the present invention achieves equivalent compensation for CTE mismatch between a steel substrate and thick-film piezoresistor through use of the interface compositions of this invention as can be achieved with prior art approaches using temperature compensation circuitry. Therefore, when formulated to have low TCGFs, the interface compositions of this invention advantageously achieve both cost effectiveness and reliability in pressure sensing applications without any compensation whatsoever.

EXPERIMENT #4

Figure 9:
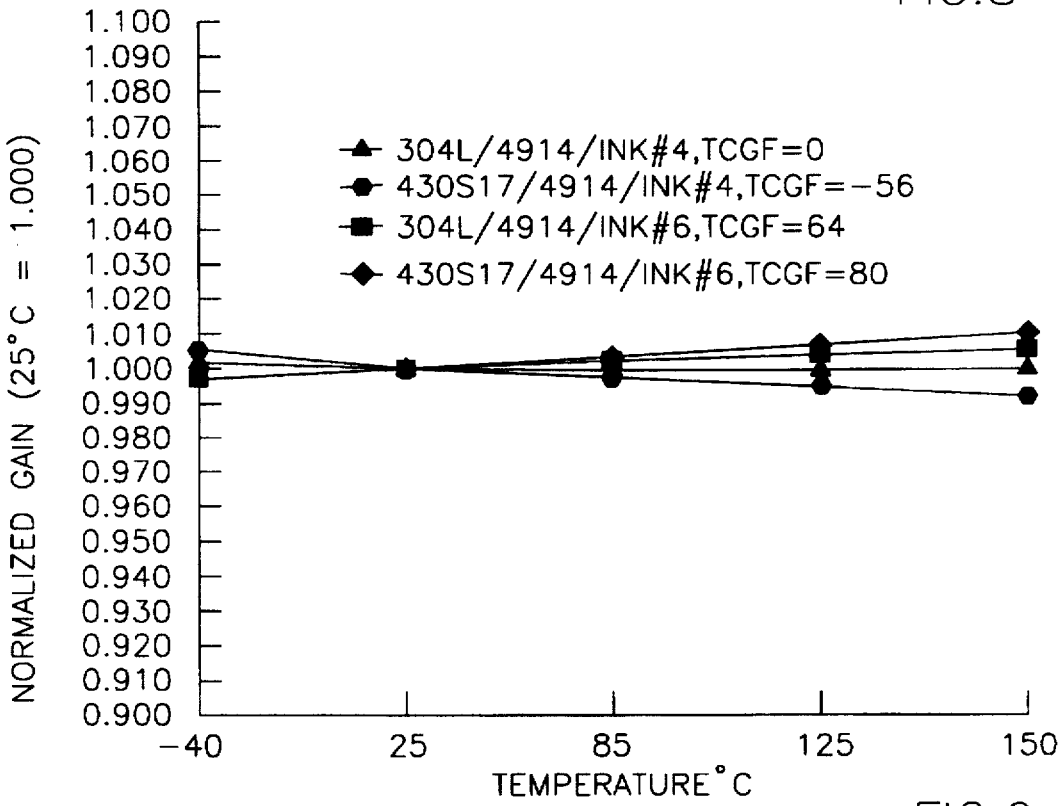
FIG. 9 is a graph showing the dependence of normalized gain on temperature for pressure sensor diaphragms formed from 304 L and 430 S17 stainless steels to include interface layers providing TCGF values within about ±170 ppm/°C. for insulative layer composition ESL D-4914.
Figure 10:
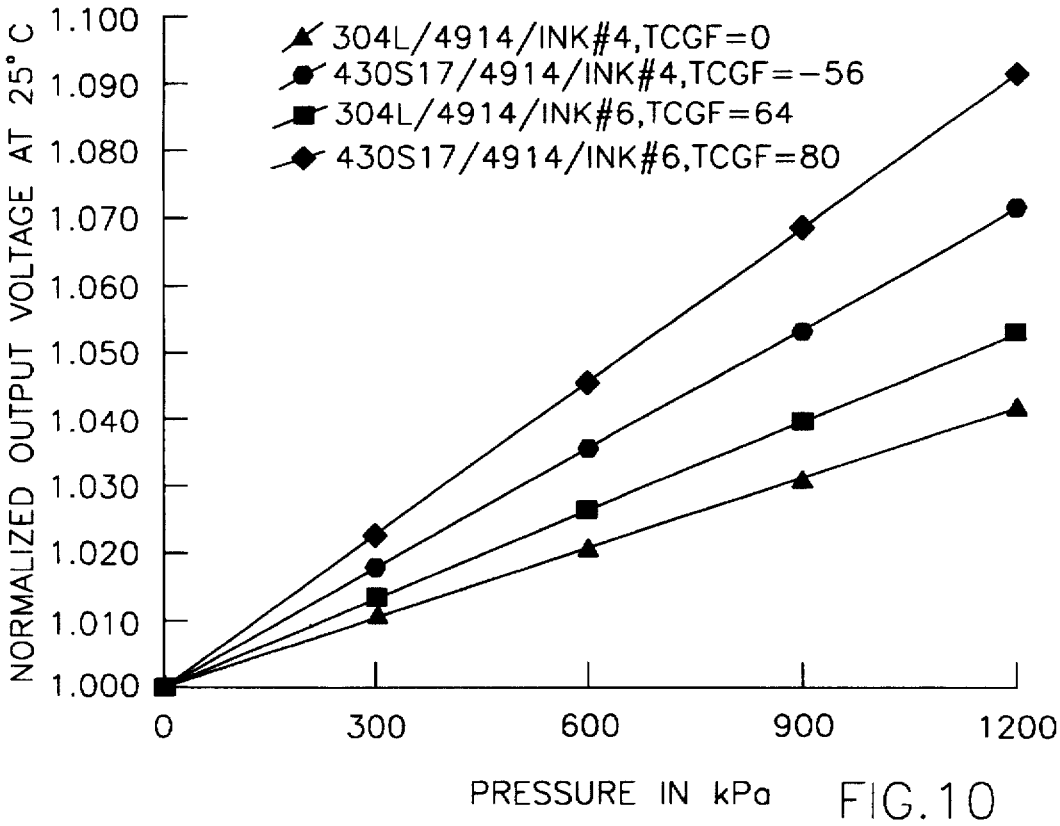
FIG. 10 is a graph showing normalized sensor output versus applied pressure on pressure sensor diaphragms formed from 304 L and 430 S17 stainless steels to include interface layers providing TCGF values within about ±170 ppm/°C. for insulative layer composition ESL D-4914.
Figure 11:
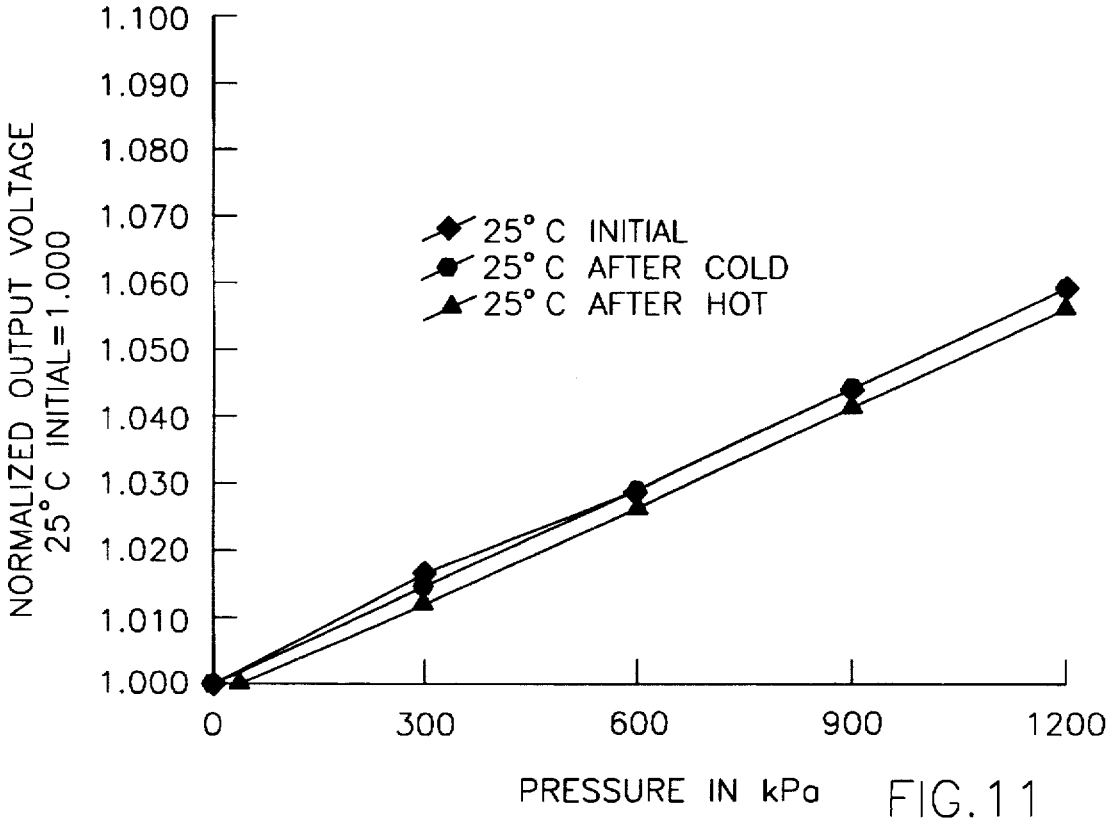
FIG. 11 is a graph showing hysteresis of normalized output voltage after 1.8 million pressure cycles for a pressure sensor diaphragm formed from 304 L stainless steel to include an insulative layer of ESL D-4914 and an interface layer of Ink #6.
Figure 12:
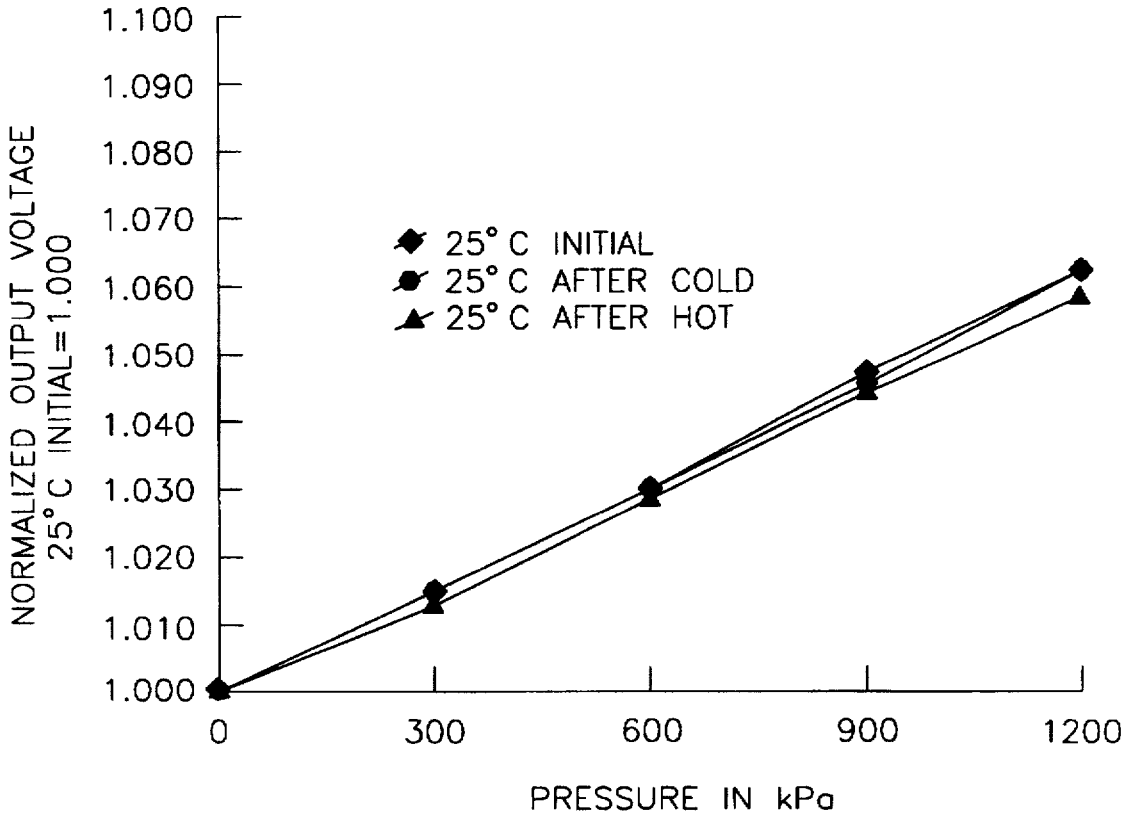
FIG. 12 is a graph showing hysteresis of normalized output voltage after 1.8 million pressure cycles for a pressure sensor diaphragm formed from 430 S17 stainless steel to include an insulative layer of ESL 4914 and an interface layer of Ink #4.

Further experimentation was performed using stainless steel diaphragms of 304 L and 430 S17. As in Experiment #3 above, the thickness of the 304 L diaphragms was about eight mils (about 0.2 mm), while the thickness of the 430 S17 diaphragms was about six mils (about 0.15 mm). For this experiment, the diaphragms were not oxidized or surface treated before printing with thick film materials. The insulator layers for this experiment were ESL D-4914, and the interface compositions were Ink #4 and Ink #6. The balance of the printing and firing process was the same as for Experiment #3. The sensing cells were assembled using standard practices into pressure sensors (minus amplification and temperature compensation circuitry) and subjected to pressure and temperature testing. The pressure ranged from zero to about 1200 kPa, and temperature excursions were from about 25° C. to about −40° C., about −40° C. to about 25° C., and about 25° C. to about 150° C. Resulting temperature related data are summarized in FIG. 9 and show variations in gain relative to temperature were within about ±1% for all steel and interface material combinations. Resulting data for normalized output in response to pressure are shown in FIG. 10 for the same steel and interface combinations. The apparent higher output or gain indicated for the 430 stainless steel cells was attributed to their thinner diaphragms. Representative cells from each of the four combinations were pressure cycled from about 0 to 300 psi for 1.8 million cycles. After cycling was completed, the cells were checked for output and linearity at 25° C. over pressures of about 0 to 1200 kPa. Following this, the cells were subjected to −40° C. and then returned to 25° C., upon which output and linearity were again measured over the 0 to 1200 kPa pressure range. Typical output, linearity and hysteresis data for each stainless steel are shown in FIGS. 11 and 12. The apparent high degree of linearity accompanied by very low hysteresis following the harsh testing sequence inclusive of 1.8 million zero-to-300 psi pressure cycles demonstrated the robustness of the dielectric layers to faithfully transmit strains induced as the diaphragms were deflected by pressure to the thick-film piezoresistor.

While our invention has been described in terms of a preferred embodiment, other forms could be adopted by one skilled in the art. For example, those skilled in the art will realize that various electrical-insulating compositions could be used to form the one or more dielectric layers 14 to appropriately match the CTE of the material of the diaphragm 12, which can differ from those alloys noted above. Furthermore, laminated tapes could be substituted for the inks and printing methods described above. Accordingly, the scope of our invention is to be limited only by the following claims.

What is claimed is:

1. A sensing structure comprising a substrate, at least one electrical-insulating layer on the substrate, an interface layer on the electrical-insulating layer, and a thick-film piezoresistor on the interface layer, the interface layer having a composition comprising particulate alumina and particulate zinc oxide closely divided and suspended in a glass matrix, the interface layer separating the piezoresistor from the electrical-insulating layer and inhibiting diffusion into the piezoresistor of constituents in the electrical-insulating layer.

2. A sensing structure as recited in claim 1, wherein the glass matrix is a lead-alumina-borosilicate glass.

3. A sensing structure as recited in claim 1, wherein the glass matrix comprises lead oxide, alumina, boron oxide, silica and one or more oxides chosen from the group consisting of titania, cupric oxide, manganese monoxide and cobalt oxide.

4. A sensing structure as recited in claim 1, wherein the electrical-insulating layer has a composition comprising metal oxides.

5. A sensing structure as recited in claim 1, wherein the substrate is a steel alloy.

6. A sensing structure as recited in claim 1, wherein the interface layer is fired from an ink composition comprising, in weight percent, about 15% to about 35% alumina, about 3% to about 6% zinc oxide, and about 34% to about 53% of a glass frit mixture, the balance being an organic media.

7. A sensing structure as recited in claim 6, wherein the glass frit mixture contains, in weight percent, about 50% to about 74% lead oxide, about 10% to about 25% boric acid as a source of boron oxide, about 8% to about 26% silica, up to about 12% alumina, up to about 3% titania, and up to 8% of at least one material selected from the group consisting of cupric oxide, manganese carbonate as a source of manganese monoxide, and cobalt carbonate as a source of cobalt oxide.

8. A sensing structure as recited in claim 7, wherein the glass frit mixture further contains, in weight percent, about 0.5% to about 3.0% cupric oxide, about 0.5% to about 4.0% manganese carbonate, about 3.5% to about 4% cobalt carbonate, alone or in combination.

9. A sensing structure as recited in claim 1, wherein the glass frit materials are formed from a combination of two glass frit mixtures.

10. A sensing structure as recited in claim 1 wherein the sensing structure is characterized by a gage factor of at least 20.

11. A sensing structure of a pressure sensor, the sensing structure comprising:

a steel alloy diaphragm;

at least one dielectric layer on the substrate, the dielectric layer having a composition comprising metal oxides;

an interface dielectric layer on and contacting the dielectric layer, the interface dielectric layer comprising particulate alumina and particulate zinc oxide closely divided and suspended in a glass matrix comprising lead oxide, alumina, boron oxide and silica; and a thick-film piezoresistor on the interface dielectric layer for sensing a deflection of the diaphragm;

wherein the interface dielectric layer separates the piezoresistor from the dielectric layers and inhibits diffusion into the piezoresistor of constituents in the dielectric layers.

12. A sensing structure as recited in claim 11, wherein the interface dielectric layer is fired from an ink composition comprising, in weight percent, about 15% to about 35% alumina, about 3% to about 6% zinc oxide, and about 34% to about 53% of a glass frit mixture, the balance being an organic media.

13. A sensing structure as recited in claim 12, wherein the ink composition comprises one or more glass frit mixtures chosen from the group consisting of first, second and third glass frit mixtures, wherein:

the first glass frit mixture contains, in weight percent, about 53.3% lead oxide, about 15.1% boric acid as a source of boron oxide, about 19.4% silica, about 8.2% alumina, about 1.0% titania, and about 3.0% cupric oxide;

the second glass frit mixture contains, in weight percent, about 53.3% lead oxide, about 15.1% boric acid as a source of boron oxide, about 19.4% silica, about 8.2% alumina, about 1.0% titania, and about 3.0% cobalt carbonate as a source of cobalt oxide; and the third glass frit mixture contains, in weight percent, about 52.8% lead oxide, about 15.0% boric acid as a source of boron oxide, about 19.2% silica, about 8.1% alumina, about 0.5% titania, about 0.5% cupric oxide, and about 4.0% manganese carbonate as a source of manganese monoxide.

14. A sensing structure as recited in claim 13, wherein the ink composition comprises, in weight percent, about 32.9% alumina, about 3.4% zinc oxide, about 27.4% of the organic media, and about 36.3 of the first glass frit mixture.

15. A sensing structure as recited in claim 13, wherein the ink composition comprises, in weight percent, about 31.0% alumina, about 4.0% zinc oxide, about 27.0% of the organic media, about 19.0% of the first glass frit mixture, and about 19.0% of the second glass frit mixture.

16. A sensing structure as recited in claim 13, wherein the ink composition layer comprises, in weight percent, about 34.9% alumina, about 5.8% zinc oxide, about 24.7% of the organic media, about 17.3 of the first glass frit mixture, and about 17.3 of the second glass frit mixture.

17. A sensing structure as recited in claim 13, wherein the ink composition comprises, in weight percent, about 30.0% alumina, about 5.0% zinc oxide, about 27.0% of the organic media, about 19.0% of the first glass frit mixture, and about 19.0% of the second glass frit mixture.

18. A sensing structure as recited in claim 13, wherein the ink composition comprises, in weight percent, about 15.0% alumina, about 5.0% zinc oxide, about 27.0% of the organic media, about 26.5% of the first glass frit mixture, and about 26.5% of the second glass frit mixture.

19. A sensing structure as recited in claim 13, wherein the ink composition comprises, in weight percent, about 30.0% alumina, about 5.0% zinc oxide, about 27.0% of the organic media, and about 38.0% of the third glass frit mixture.

20. A sensing structure as recited in claim 11, wherein the sensing structure is characterized by a gage factor of greater than 20.

* * * * *